US011424566B2

(12) United States Patent
Chen et al.

(10) Patent No.: US 11,424,566 B2
(45) Date of Patent: Aug. 23, 2022

(54) HIGH-DENSITY CONNECTING DEVICE

(71) Applicant: NEXTRONICS ENGINEERING CORP., New Taipei (TW)

(72) Inventors: Yen-Cheng Chen, New Taipei (TW); Hou-An Su, Keelung (TW); Frank Hsu, New Taipei (TW); Yu-Ting Sun, Keelung (TW); Yong Zhang, Guangzhou (CN)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 17/325,360

(22) Filed: May 20, 2021

(65) Prior Publication Data

US 2022/0231440 A1 Jul. 21, 2022

(30) Foreign Application Priority Data

Jan. 21, 2021 (CN) ..... 202110081225.4

(51) Int. Cl.
*H01R 12/73* (2011.01)
*H01R 4/48* (2006.01)

(52) U.S. Cl.
CPC ..... *H01R 12/732* (2013.01); *H01R 4/4863* (2013.01)

(58) Field of Classification Search
CPC ..... H01R 4/4863
USPC ..... 439/76.1
See application file for complete search history.

(56) References Cited

U.S. PATENT DOCUMENTS 5,219,292 A * 6/1993 Dickirson ..... H01R 12/62 439/67
5,373,109 A * 12/1994 Argyrakis ..... H01R 12/774 174/117 FF
5,741,148 A * 4/1998 Biernath ..... H01R 12/79 439/493
5,764,497 A * 6/1998 Mizumo ..... H05K 3/361 439/55
5,920,465 A * 7/1999 Tanaka ..... H01R 12/62 361/784
6,508,674 B1 * 1/2003 Svenkeson ..... H01R 12/78 439/631
6,641,408 B1 * 11/2003 Svenkeson ..... H01R 12/82 439/67
6,699,395 B1 * 3/2004 Svenkeson ..... H05K 1/118 216/13

(Continued)

*Primary Examiner* — Harshad C Patel
(74) *Attorney, Agent, or Firm* — Li & Cai Intellectual Property (USA) Office

(57) ABSTRACT

A high-density connecting device is provided. The high-density connecting device includes a first connecting module and a second connecting module. The first connecting module includes a first casing assembly, a first circuit board, and a first socket connector. The second connecting module includes a second casing assembly, a second circuit board, and a second socket connector. When the first connecting module is mated with the second connecting module, a junction end of the first circuit board and a junction end of the second circuit board are inserted into the first socket connector and the second socket connector, respectively, so that the junction end of the first circuit board and the junction end of the second circuit board are electrically connected to the first socket connector and the second socket connector, respectively.

10 Claims, 18 Drawing Sheets

(56) References Cited

U.S. PATENT DOCUMENTS

| | | | | |
|---|---|---|---|---|
| 6,739,903 | B1 * | 5/2004 | Aoki | H01R 12/89 439/496 |
| 8,777,664 | B2 * | 7/2014 | Gui | H01R 13/6471 439/607.25 |
| 8,911,262 | B1 * | 12/2014 | Lei | H01R 24/60 439/79 |
| 9,065,212 | B2 * | 6/2015 | Golko | H01R 13/631 |
| 2010/0248544 | A1 * | 9/2010 | Xu | H01R 13/6658 439/607.04 |
| 2010/0285682 | A1 * | 11/2010 | Wu | H01R 13/6275 439/357 |
| 2017/0338577 | A1 * | 11/2017 | Amini | H01R 24/66 |

* cited by examiner

HIGH-DENSITY CONNECTING DEVICE

CROSS-REFERENCE TO RELATED PATENT APPLICATION

This application claims the benefit of priority to China Patent Application No. 202110081225.4, filed on Jan 21, 2021 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a high-density connecting device, and more particularly to a connecting device with high-density contacts.

BACKGROUND OF THE DISCLOSURE

Conventional connectors are used as connecting devices for electrically connecting to cables, circuit boards, and other circuit components, and have been widely applied to various electronic products in our daily life. Conventional connectors can be applied to the field of medical instruments. For certain medical instruments, a requirement of an integration of new technology and new functions of contact equipment, and a rising demand of functional enhancement have led to an increase in a number of contacts needed for transmitting in the connectors. However, the number of contacts in a single connector is limited.

SUMMARY OF THE DISCLOSURE

In response to the above-referenced technical inadequacy the present disclosure provides a high-density connecting device, which is able to effectively increase a density of contacts and generate high-density signal contacts.

In one aspect, the present disclosure provides a high-density connecting device, which includes a first connecting module and a second connecting module. The first connecting module includes a first casing assembly, a first circuit board, and a first socket connector. The first socket connector is disposed on one surface of the first circuit board, and the first socket connector is electrically connected to the first circuit board. The first circuit board and the first socket connector are disposed in the first casing assembly. A first junction end is formed at one end of the first circuit board. A plurality of first contacts are disposed on at least one surface of the first junction end. The first socket connector is arranged in proximity to the first junction end on the one surface of the first circuit board. The second connecting module includes a second casing assembly, a second circuit board, and a second socket connector. The second socket connector is disposed on one surface of the second circuit board, and the second socket connector is electrically connected to the second circuit board.

The second circuit board and the second socket connector are disposed in the second casing assembly. A second junction end is formed at one end of the second circuit board. A plurality of second contacts are disposed on at least one surface of the second junction end. The second socket connector is arranged in proximity to the second junction end on the one surface of the second circuit board. When the first connecting module is mated with the second connecting module, the first junction end of the first circuit board is inserted into the second socket connector, so that the first junction end of the first circuit board is electrically connected to the second socket connector, and the second junction end of the second circuit board is inserted into the first socket connector, so that the second junction end of the second circuit board is electrically connected to the first socket connector.

In another aspect, the present disclosure provides a high-density connecting device, which includes a first connecting module and a second connecting module. The first connecting module includes a first casing assembly and two first circuit boards. A first junction end is formed at one end of each of the two first circuit boards. A plurality of first contacts are disposed on at least one surface of the first junction end. A second connecting module includes a second casing assembly, a second circuit board, a first socket connector, and a second socket connector. The first socket connector is disposed on one surface of the second circuit board, and the first socket connector is electrically connected to the second circuit board. The second socket connector is disposed on another surface of the second circuit board, and the second socket connector is electrically connected to the second circuit board. The second circuit board, the first socket connector, and the second socket connector are disposed in the second casing assembly. When the first connecting module is mated with the second connecting module, the first junction ends of the two first circuit boards are inserted into the first socket connector and the second socket connector, respectively, so that the first junction ends of the two first circuit boards are electrically connected to the first socket connector and the second socket connector, respectively.

Therefore, the high-density connecting device provided by the present disclosure includes the first connecting module and the second connecting module. The first connecting module and the second connecting module include the first socket connector, the second socket connector, and the two circuit boards. When the first connecting module is mated with the second connecting module, the junction ends of the two circuit boards are inserted into the first socket connector and the second socket connector, respectively, so that the junction ends of the two circuit boards are electrically connected to the first socket connector and the second socket connector, respectively. Accordingly, high-density signal contacts are formed in a limited volume.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
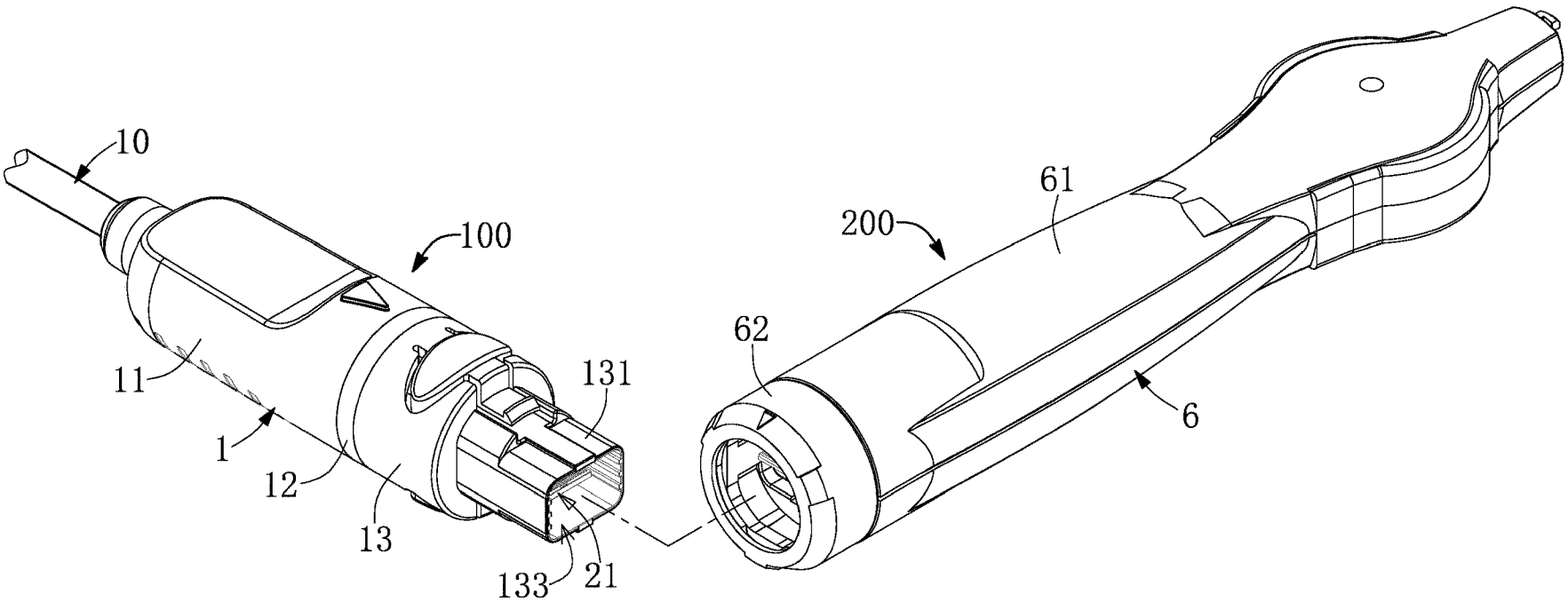
FIG. 1 is a schematic perspective view of a high-density connecting device in a disconnecting state according to the present disclosure.
Figure 2:
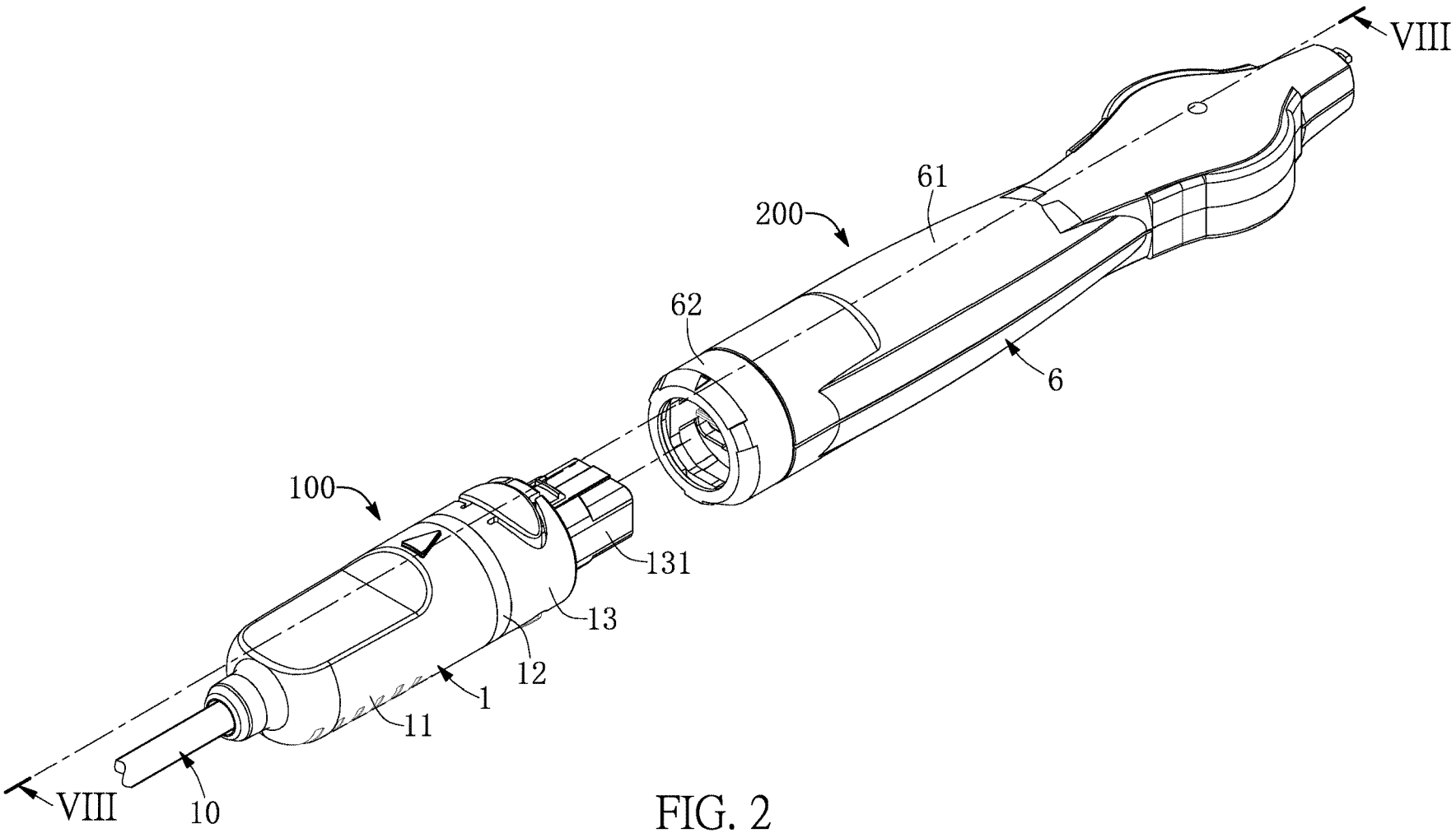
FIG. 2 is another schematic perspective view of the high-density connecting device in the disconnecting state according to the present disclosure.
Figure 3:
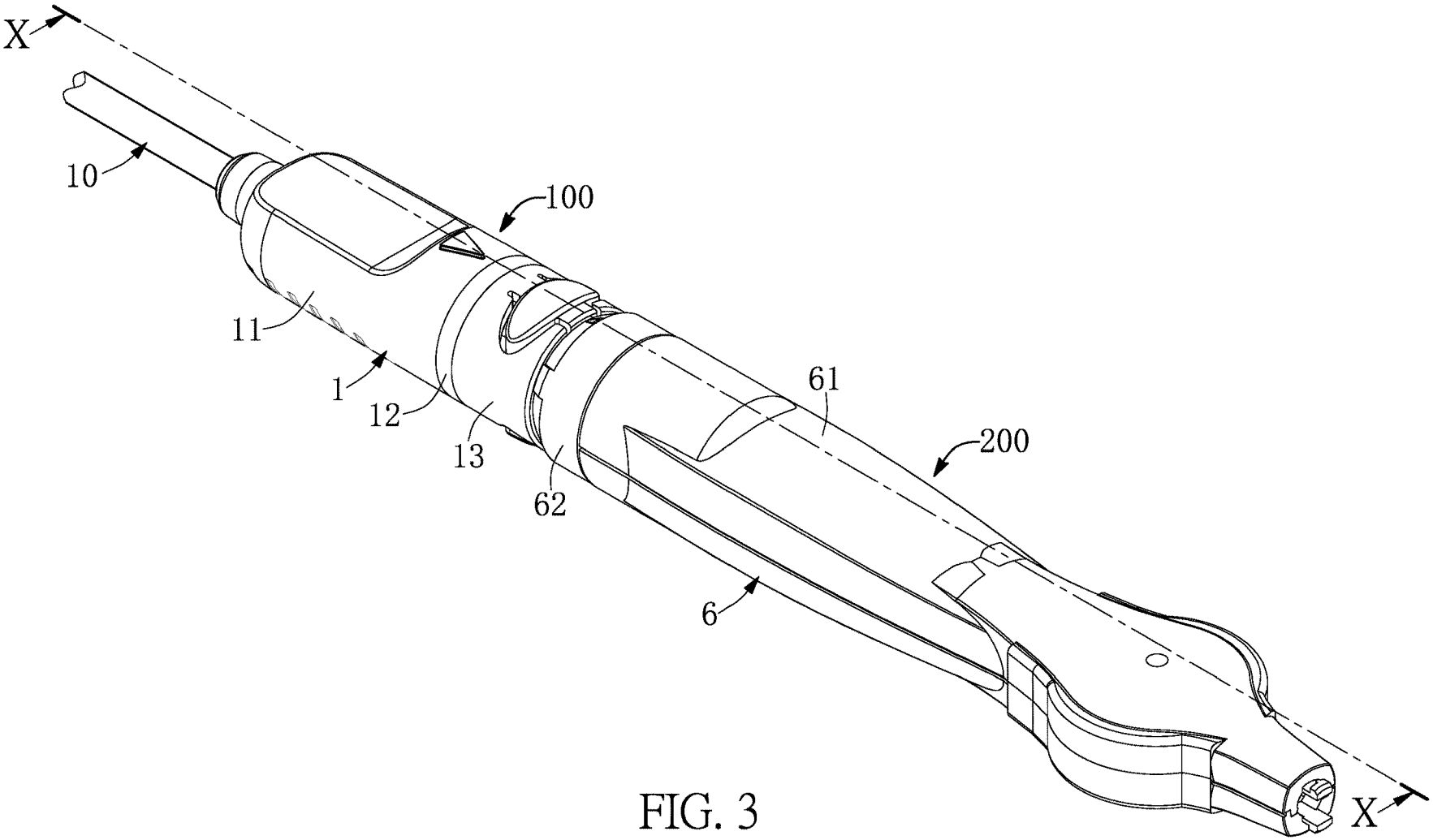
FIG. 3 is a schematic perspective view of the high-density connecting device in a connecting state according to the present disclosure.
Figure 4:
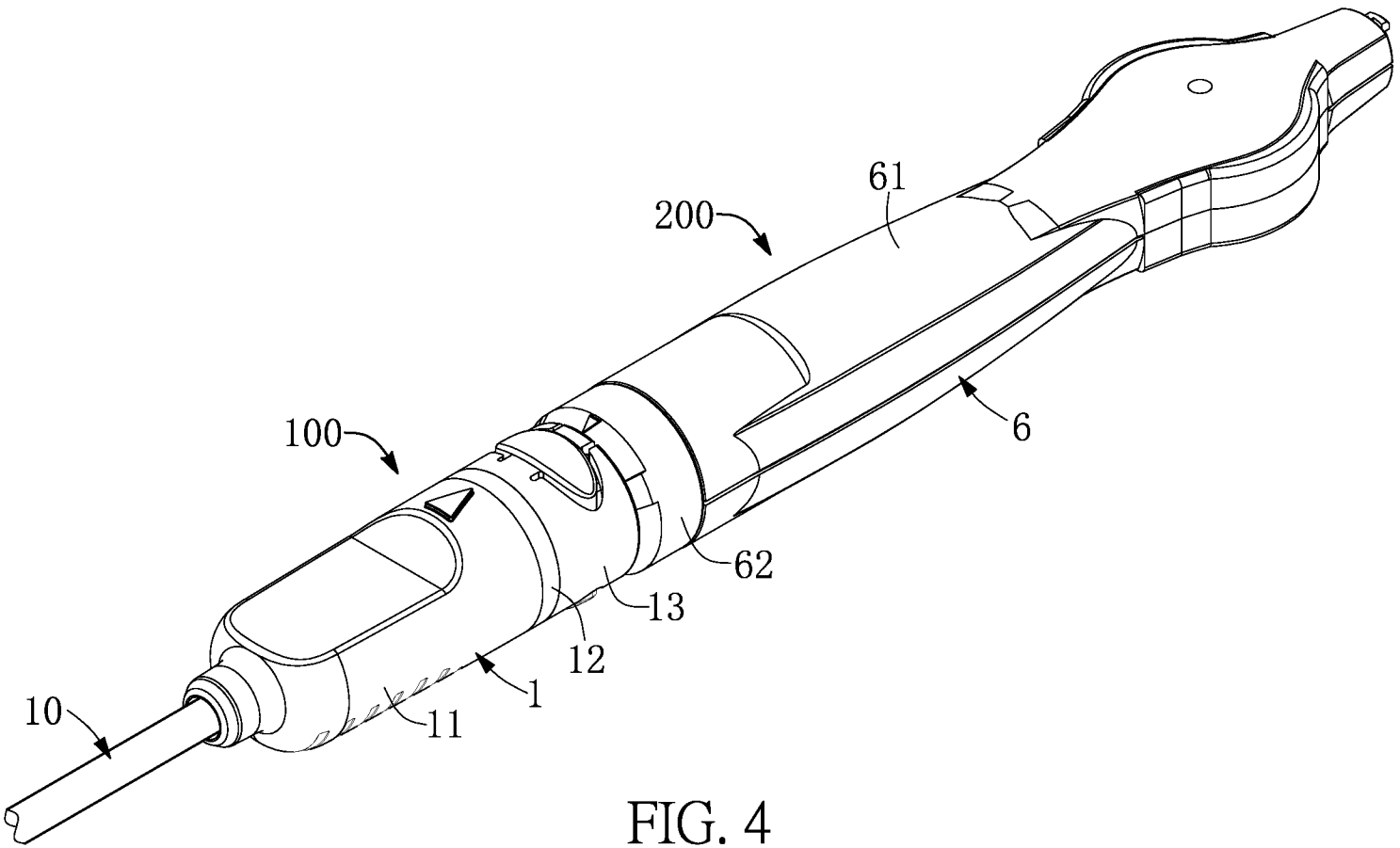
FIG. 4 is another schematic perspective view of the high-density connecting device in the connecting state according to the present disclosure.
Figure 5:
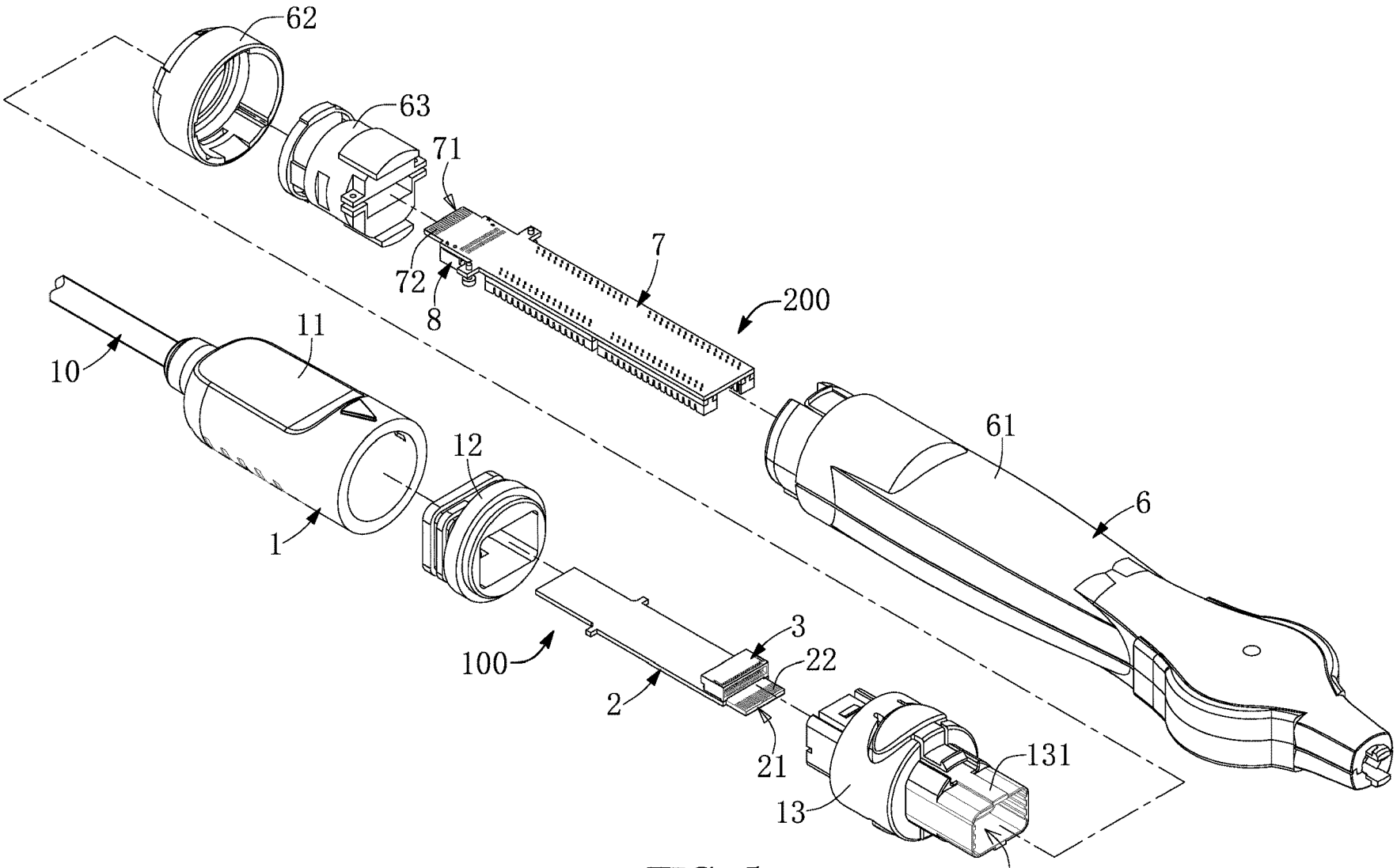
FIG. 5 is a schematic exploded view of the high-density connecting device according to the present disclosure.
Figure 6:
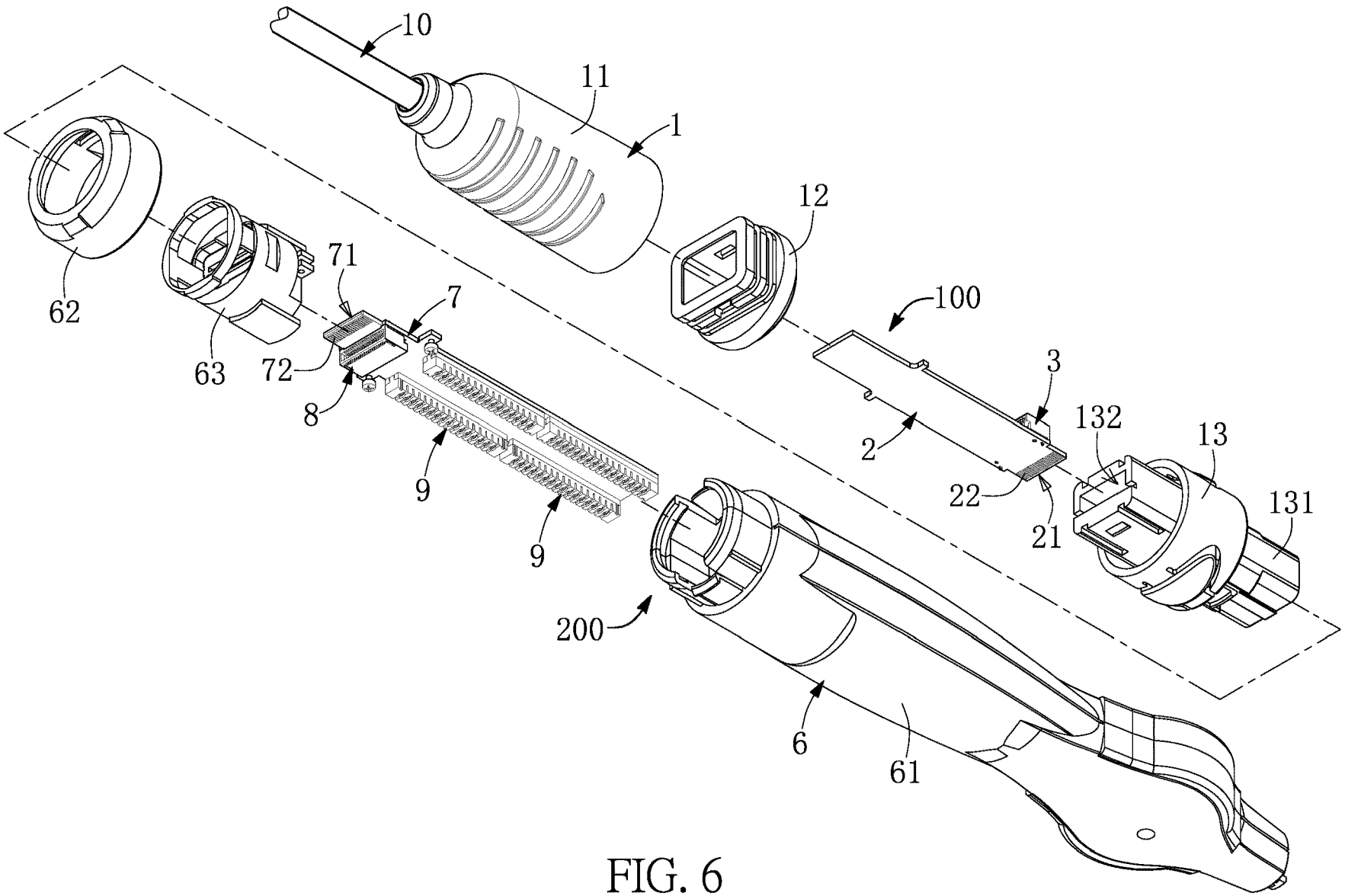
FIG. 6 is another schematic exploded view of the high-density connecting device according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

[First Embodiment]

Figure 9:
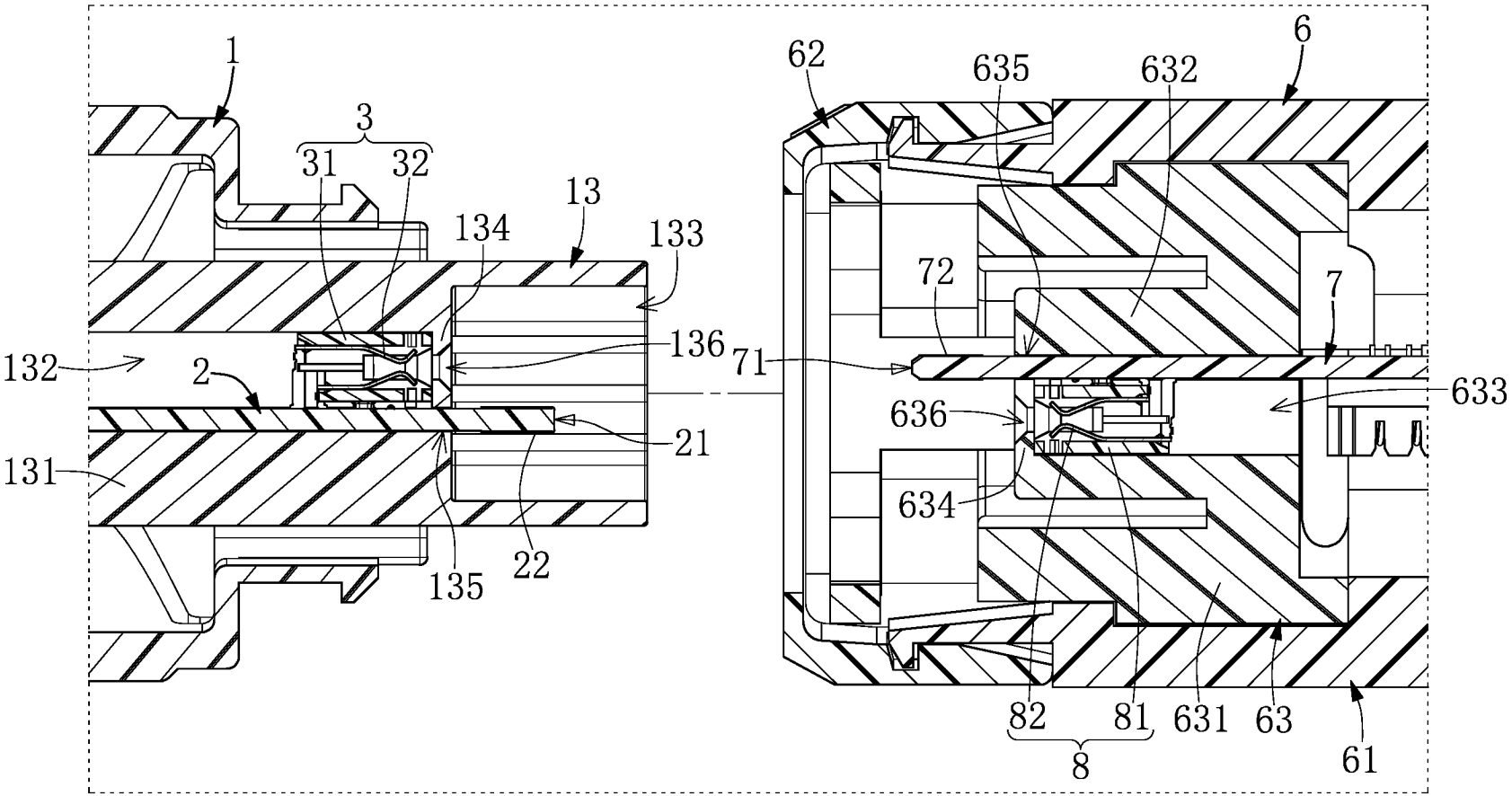
FIG. 9 is an enlarged view of part IX of FIG. 8.

Referring to FIG. 1 to FIG. 6, the present disclosure provides a high-density connecting device, which includes a first connecting module 100 and a second connecting module 200. Referring to FIG. 8 to FIG. 11, the first connecting module 100 includes a first casing assembly 1, a first circuit board 2, and a first socket connector 3. The first casing assembly 1 can be a composite structure including a plurality of components assembled to form a hollow body. In the present embodiment, the first casing assembly 1 can include a first casing 11, a first cover 12, and a first connector 13. The first connector 13 is disposed at one end (a front end) of the first casing 11. In the present embodiment, the first cover 12 is disposed between the first casing 11 and the first connector 13. The first connector 13 has a first body 131, and a first space 132 and a slot 133 are formed inside the first body 131 (as shown in FIG. 9). A first partition plate 134 is disposed between the first space 132 and the slot 133. A first through hole 135 and a second through hole 136 are disposed on the first partition plate 134.

The first socket connector 3 is disposed on one surface (a top surface) of the first circuit board 2, and the first socket connector 3 is electrically connected to the first circuit board 2. The first socket connector 3 can be of various types of electrical connectors, and types as well as structures thereof are not limited. The first socket connector 3 can include a first electrically insulating body 31 and a plurality of first terminals 32 that are disposed on the first electrically insulating body 31. The plurality of first terminals 32 can be used to transmit electrical power, signals, etc. Since the first socket connector 3 is a prior art, details thereof are not reiterated herein.

The first circuit board 2 and the first socket connector 3 are disposed in the first casing assembly 1. In the present embodiment, the first circuit board 2 and the first socket connector 3 are disposed in the first space 132 of the first connector 13. A first junction end 21 is formed at one end of the first circuit board 2, and the first socket connector 3 is arranged in proximity to the first junction end 21 on the one surface of the first circuit board 2. A plurality of first contacts 22 are disposed on at least one surface of the first junction end 21. Preferably, the plurality of first contacts 22 are disposed on both surfaces (a top surface and a bottom surface) of the first junction end 21. The first junction end 21 of the first circuit board 2 can pass through the first through hole 135 and extend into the slot 133, thereby supporting the first circuit board 2 in a stable position. The first socket connector 3 can correspond to the second through hole 136, so that when the first connecting module 100 is mated with the second connecting module 200, a second junction end 71 of a second circuit board 7 can pass through the second through hole 136 and can be inserted into the first socket connector 3, thereby guiding a stable insertion of the second circuit board 7. The first circuit board 2 can be electrically connected to a cable 10.

The second connecting module 200 includes a second casing assembly 6, the second circuit board 7, and a second socket connector 8. The second casing assembly 6 can be a composite structure including a plurality of components assembled to form a hollow body. In the present embodiment, the second casing assembly 6 can include a second casing 61, a second cover 62, and a second connector 63. The second connector 63 is disposed at one end of the second casing 61. In the present embodiment, the second connector 63 is disposed between the second casing 61 and the second cover 62. The second connector 63 has a second body 631, and a cylinder 632 and a second space 633 are formed inside the second body 631 (as shown in FIG. 9). The cylinder 632 corresponds to the slot 133, so that the cylinder 632 can be inserted into the slot 133 when the first connecting module 100 is mated with the second connecting module 200. The second space 633 is arranged inside the cylinder 632. One end of the cylinder 632 includes a second partition plate 634, and a third through hole 635 and a fourth through hole 636 are disposed on the second partition plate 634.

The second socket connector 8 is disposed on one surface (a bottom surface) of the second circuit board 7, and the second socket connector 8 is electrically connected to the second circuit board 7. The second socket connector 8 can be of various types of electrical connectors, and types as well as structures thereof are not limited. The second socket connector 8 can include a second electrically insulating body 81 and a plurality of second terminals 82 that are disposed on the second electrically insulating body 81. The plurality of second terminals 82 can be used to transmit electrical power, signals, etc. Since the second socket connector 8 is a prior art, details thereof are not reiterated herein.

The second circuit board 7 and the second socket connector 8 are disposed in the second casing assembly 6. In the present embodiment, the second circuit board 7 and the second socket connector 8 are disposed in the second space 633 of the second connector 63. The second junction end 71 is formed at one end of the second circuit board 7, and the second socket connector 8 is arranged in proximity to the second junction end 71 on the one surface of the second circuit board 7. A plurality of second contacts 72 are disposed on at least one surface of the second junction end 71. Preferably, the plurality of second contacts 72 are disposed on both surfaces (a top surface and a bottom surface) of the second junction end 71. The second junction end 71 of the second circuit board 7 can pass through the third through hole 635 and extend outside the cylinder 632, thereby supporting the second circuit board 7 in a stable position. The second socket connector 8 can correspond to the fourth through hole 636, so that when the first connecting module 100 is mated with the second connecting module 200, the first junction end 21 of the first circuit board 2 can pass through the fourth through hole 636 and can be inserted into the second socket connector 8, thereby guiding a stable insertion of the first circuit board 2.

Figure 10:
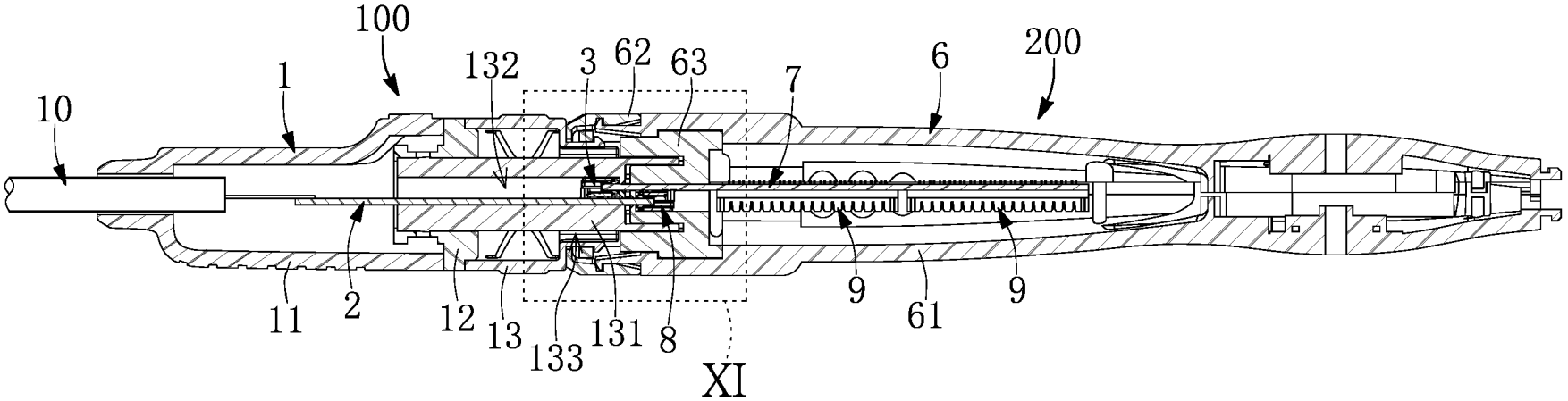
FIG. 10 is a schematic sectional view taken along line X-X of FIG. 3.
Figure 11:
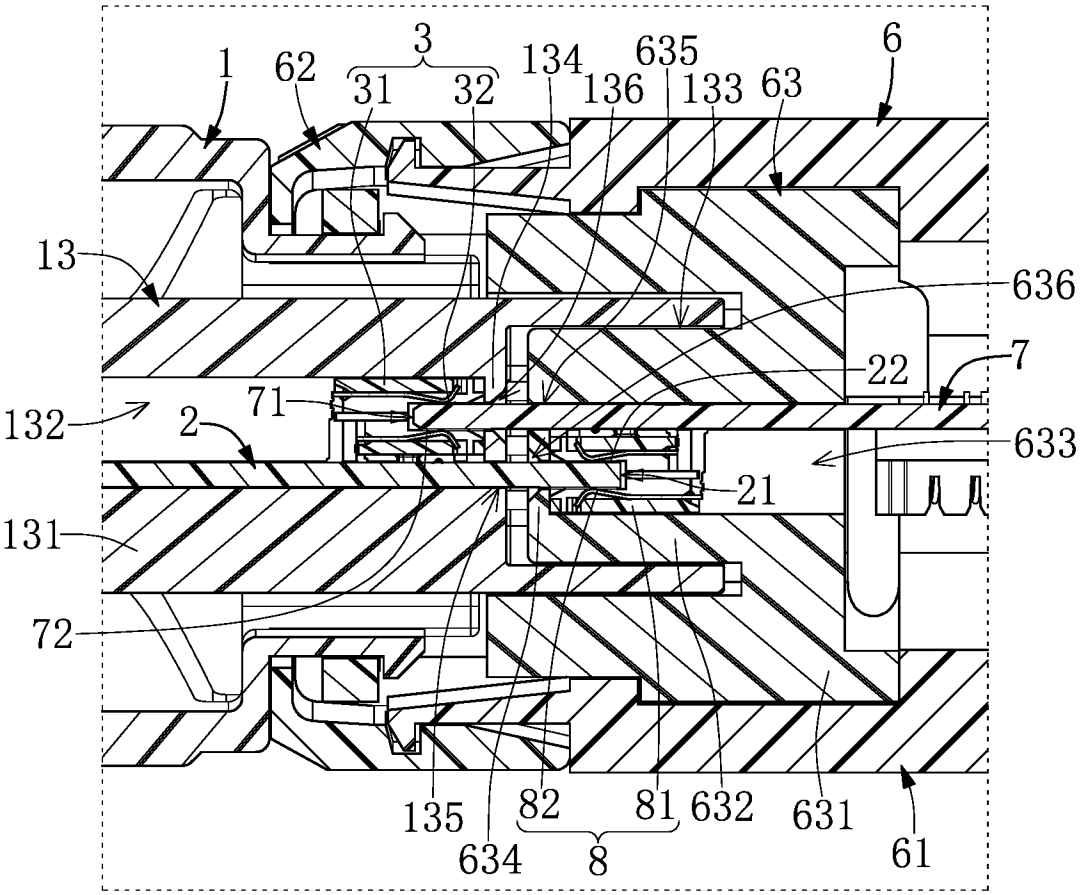
FIG. 11 is an enlarged view of part XI of FIG. 10.
Figure 12:
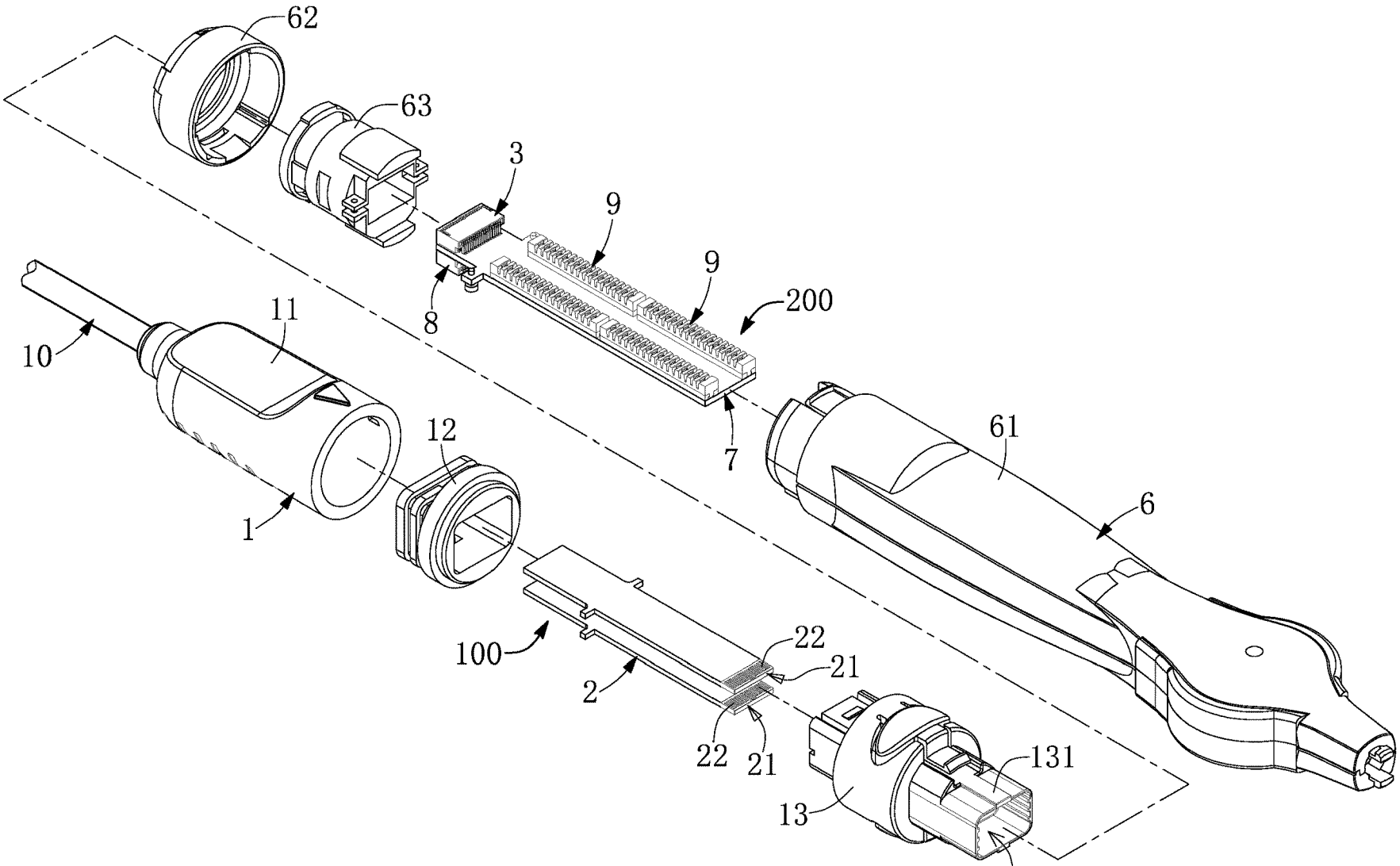
FIG. 12 is a schematic exploded view of a high-density connecting device according to a second embodiment of the present disclosure.
Figure 13:
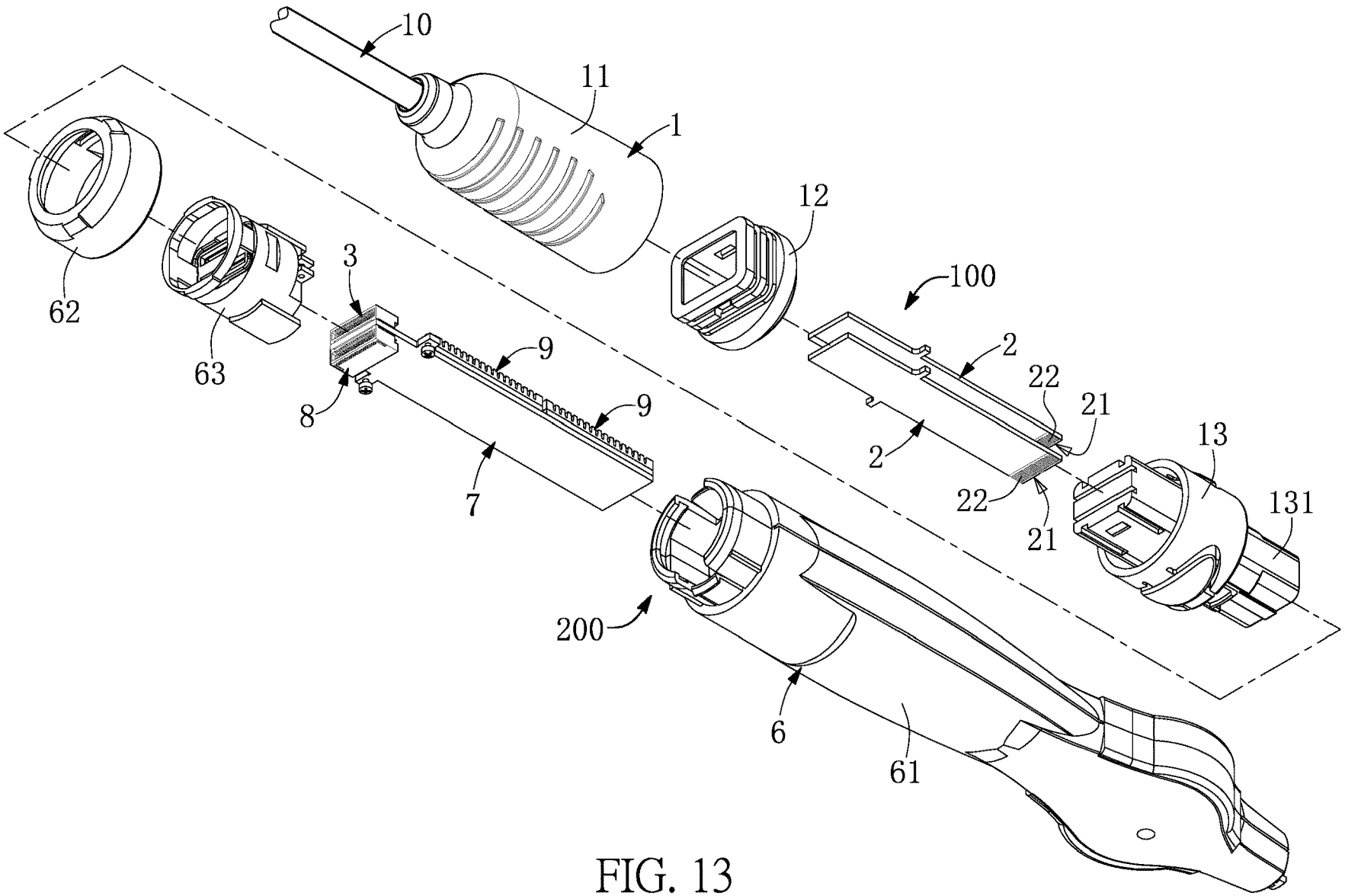
FIG. 13 is another schematic exploded view of the high-density connecting device according to the second embodiment of the present disclosure.
Figure 14:
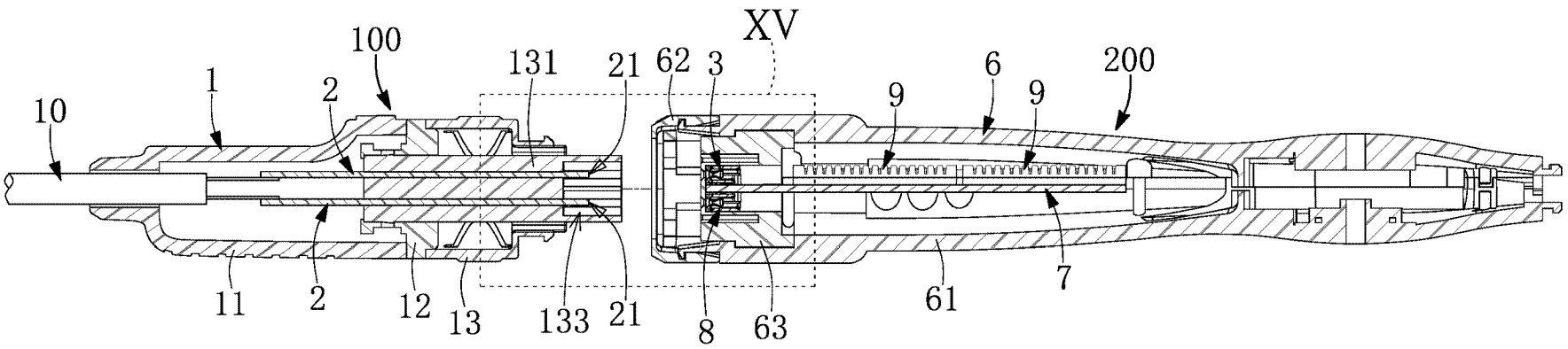
FIG. 14 is a schematic sectional view of the high-density connecting device in a disconnecting state according to the second embodiment of the present disclosure.
Figure 15:
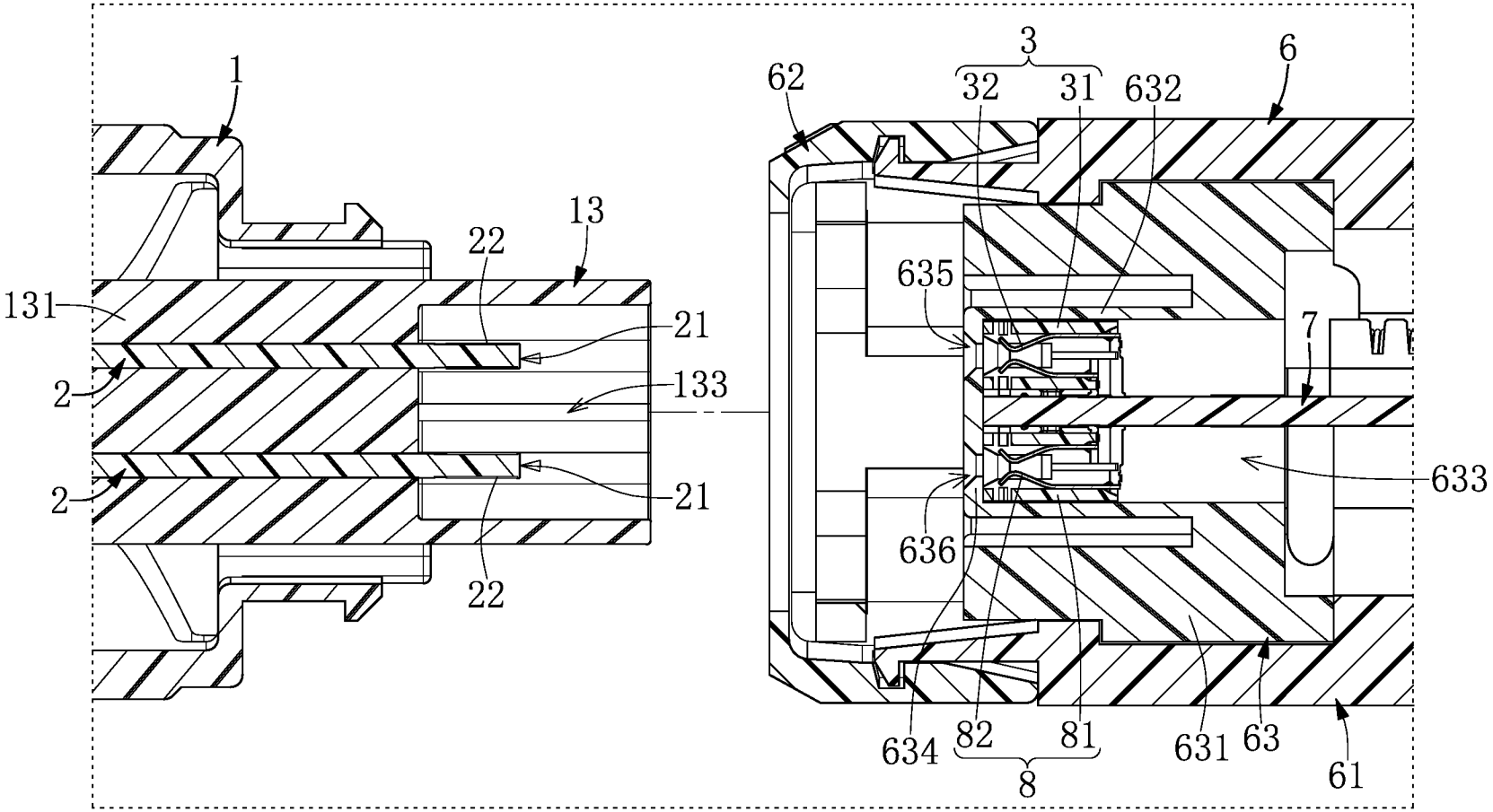
FIG. 15 is an enlarged view of part XV of FIG. 14.
Figure 16:
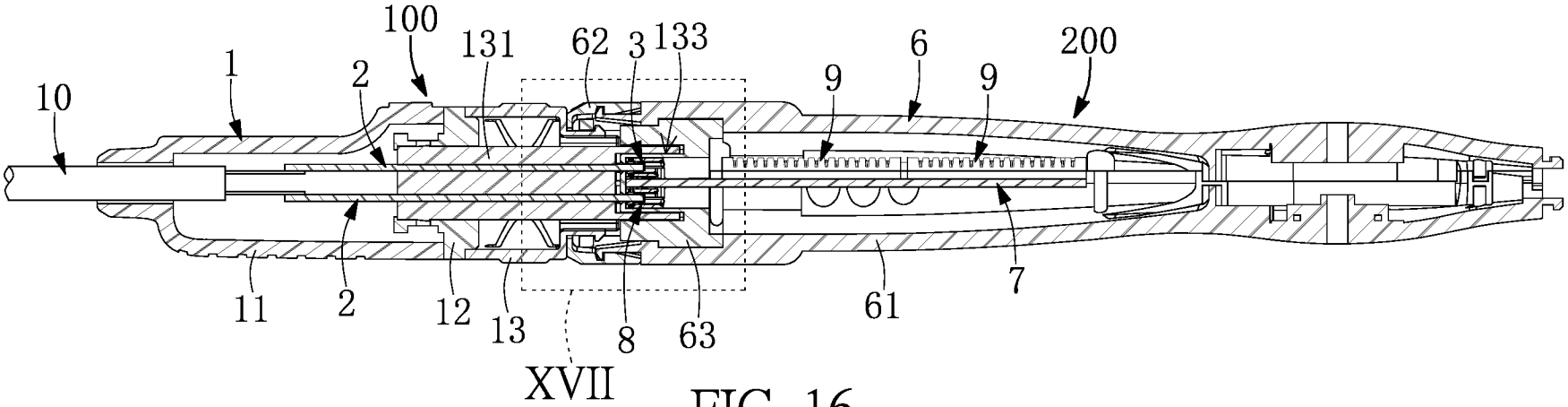
FIG. 16 is a schematic sectional view of the high-density connecting device in a connecting state according to the second embodiment of the present disclosure.
Figure 17:
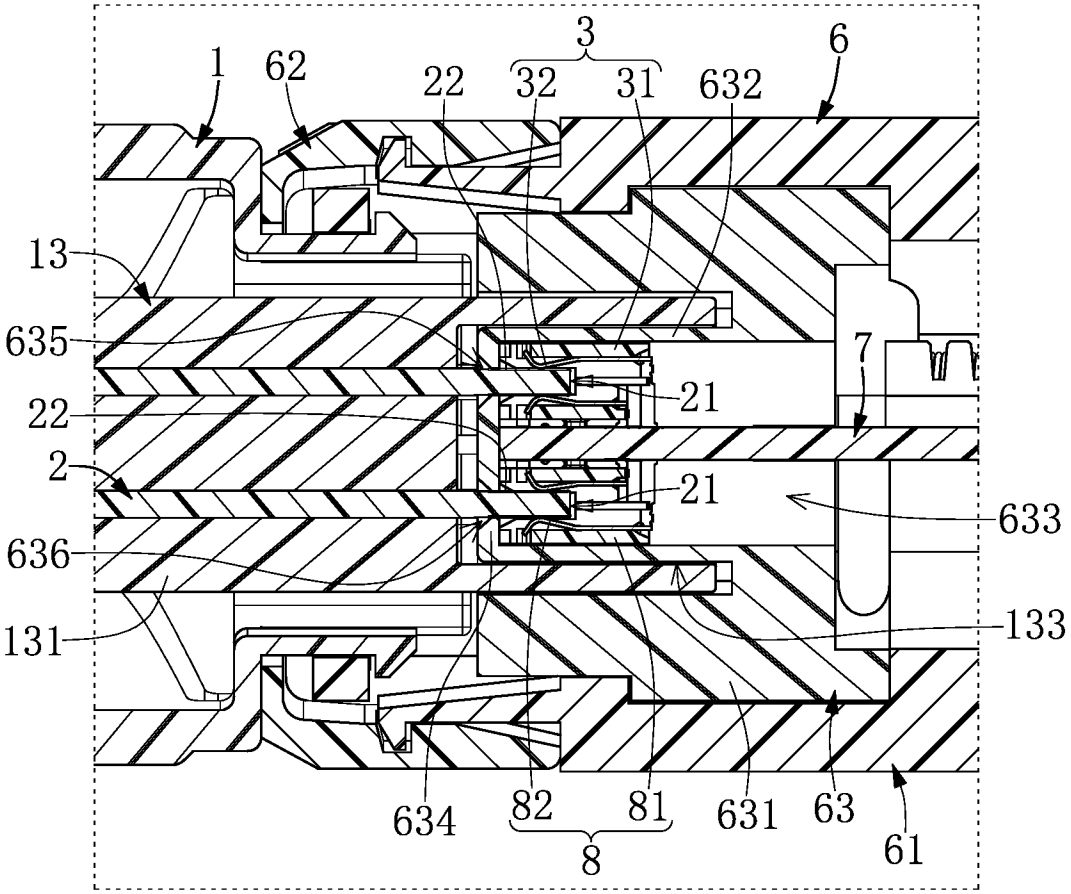
FIG. 17 is an enlarged view of part XVII of FIG. 16.

Referring to FIG. 10 and FIG. 11, when the first connecting module 100 is mated with the second connecting module 200, the first junction end 21 of the first circuit board 2 can be inserted into the second socket connector 8, so that the first contact 22 of the first junction end 21 of the first circuit board 2 contacts the second terminal 82 of the second socket connector 8, which allows the first junction end 21 of the first circuit board 2 to be electrically connected to the second socket connector 8. At the same time, the second junction end 71 of the second circuit board 7 can be inserted into the first socket connector 3, so that the second contact 72 of the second junction end 71 of the second circuit board 7 contacts the first terminal 32 of the first socket connector 3, which allows the second junction end 71 of the second circuit board 7 to be electrically connected to the first socket connector 3. The first circuit board 2 is mated with the second socket connector 8, and the first socket connector 3 is mated with the second circuit board 7, such that the first connecting module 100 and the second connecting module 200 can form a connecting unit that simultaneously has a male connector and a female connector. Accordingly, high-density signal contacts can be formed in a limited volume.

Figure 7:
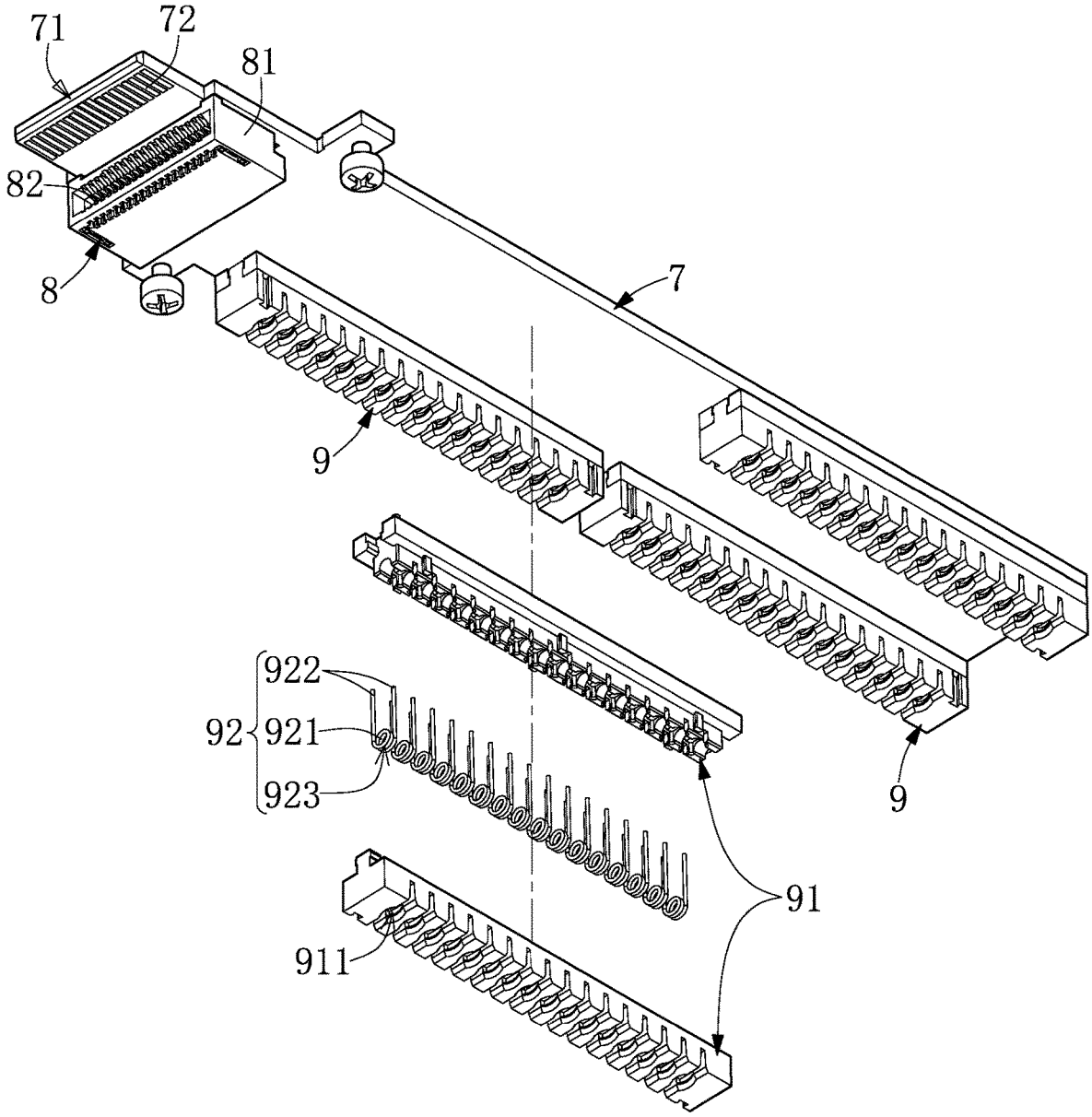
FIG. 7 is a schematic exploded view of a spring connector according to the present disclosure.
Figure 8:
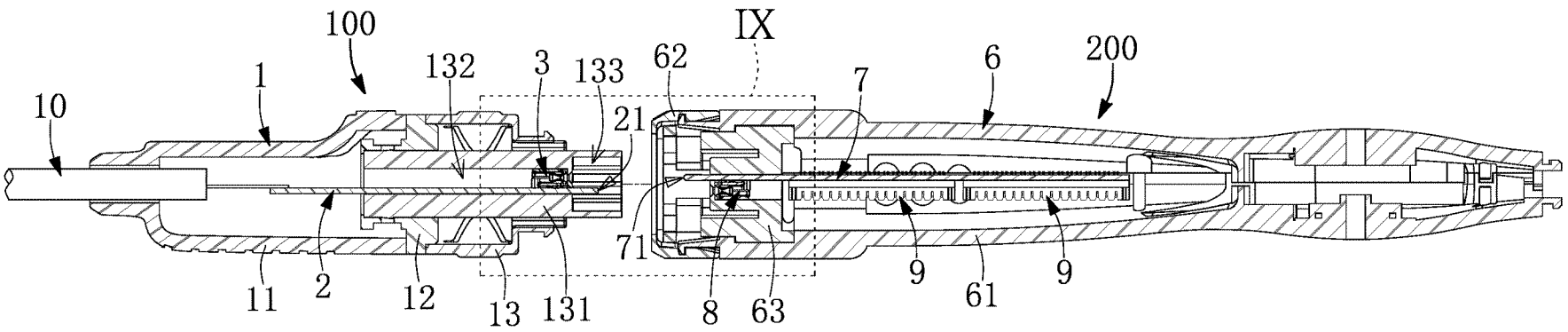
FIG. 8 is a schematic sectional view taken along line VIII-VIII of FIG. 2.
Figure 18:
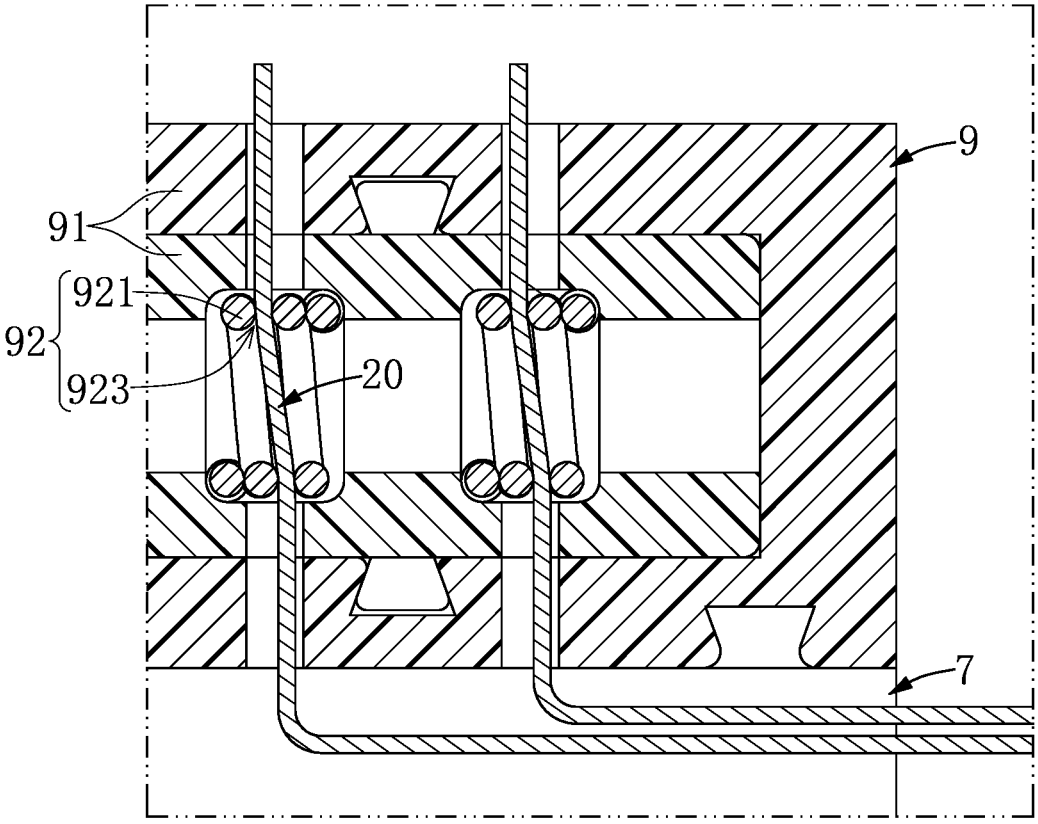
FIG. 18 is a schematic sectional view of the spring connector clamping wires according to the present disclosure.

At least one spring connector 9 can also be disposed on the first circuit board 2 or the second circuit board 7. In the present embodiment, the at least one spring connector 9 is disposed on the second circuit board 7 (as shown in FIG. 7). The at least one spring connector 9 includes a third electrically insulating body 91 and a plurality of spring terminals 92. In the present embodiment, the third electrically insulating body 91 is a two-piece composite design, but it is not limited thereto. The third electrically insulating body 91 has a plurality of wire slots 911 arranged at intervals. The plurality of spring terminals 92 are disposed on the third electrically insulating body 91. The plurality of spring terminals 92 each have a contact portion 921 and at least one pin portion 922. The contact portion 921 extends in a spiral pattern, and a slit 923 is formed in the contact portion 921. The pin portion 922 is connected to the contact portion 921. The pin portion 922 can be electrically connected to the second circuit board 7 (or the first circuit board 2). Each of the contact portions 921 of the plurality of spring terminals 92 extends into the plurality of wire slots 911, so that each of wires 20 (conducting portions; as shown in FIG. 7 and FIG. 18) can be correspondingly arranged into the plurality of wire slots 911 of the electrically insulating body 91, and can be clamped by the corresponding contact portions 921 of the plurality of spring terminals 92, which allows the wires 20 to be clamped in the slit 923 of the plurality of spring terminals 92. Accordingly, the wires 20 are electrically connected to the plurality of spring terminals 92, so that the wires 20 can be electrically connected to the second circuit board 7 (or the first circuit board 2) through the spring connector 9. The spring connector 9 can be used for clamping the wire 20 that has a small diameter. In addition, wire breaking during soldering or a problem of bad soldering can be avoided.

[Second Embodiment]

Referring to FIG. 12 to FIG. 17, a difference between the present embodiment and the first embodiment is that, in the present embodiment, both the first socket connector 3 and the second socket connector 8 are disposed on the second circuit board 7. The first socket connector 3 is disposed on one surface (a top surface) of the second circuit board 7, and the first socket connector 3 is electrically connected to the second board 7. The second socket connector 8 is disposed on another surface (a bottom surface) of the second circuit board 7, and the second socket connector 8 is electrically connected to the second circuit board 7.

The second circuit board 7, the first socket connector 3, and the second socket connector 8 are disposed in the second casing assembly 6. In the present embodiment, a cylinder 632 and a space (the second space 633) are formed in the second body 631. The space (the second space 633) is arranged inside the cylinder 632. One end of the cylinder 632 includes a partition plate (the second partition plate 634), and two through holes (the third through hole 635 and the fourth through hole 636) are disposed on the partition plate (the second partition plate 634). The second circuit board 7, the first socket connector 3, and the second socket connector 8 are disposed inside the space (the second space 633) of the second connector 63, and the second junction end 71 of the second circuit board 7 described in the above-mentioned embodiment is omitted. The first socket connector 3 and the second socket connector 8 are disposed in proximity to one end of the two surfaces of the second circuit board 7, respectively.

The first socket connector 3 and the second socket connector 8 can correspond to the two through holes (the third through hole 635 and the fourth through hole 636), respectively, so that when the first connecting module 100 is mated with the second connecting module 200, the first junction ends 21 of the two first circuit boards 2 pass through the two through holes (the third through hole 635 and the fourth through hole 636), and are inserted into the first socket connector 3 and the second socket connector 8, respectively, thereby guiding the two first circuit boards 2 in a stable insertion. In the present embodiment, a number of the first circuit boards 2 disposed in the first connecting module 100 is two. The two first circuit boards 2 are disposed in the first casing assembly 1. The two first circuit boards 2 can be disposed in the first body 131 of the first connector 13, and the first junction ends 21 of the two first circuit boards 2 extend into the slot 133.

When the first connecting module 100 is mated with the second connecting module 200, the first junction ends 21 of the two first circuit boards 2 can be inserted into the first socket connector 3 and the second socket connector 8, respectively, so that the first contacts 22 of the first junction ends 21 of the two first circuit boards 2 contact the first terminal 32 of the first socket connector 3 and the second terminal 82 of the second socket connector 8, respectively.

Accordingly, the first junction ends 21 of the two first circuit boards 2 are electrically connected to the first socket connector 3 and the second socket connector 8, respectively. In the present embodiment, two pairs of connecting units are provided between the first connecting module 100 and the second connecting module 200, so that high-density signal contacts can be formed in a limited volume.

[Beneficial Effects of the Embodiments]

In conclusion, the high-density connecting device provided by the present disclosure includes the first connecting module and the second connecting module. The first connecting module and the second connecting module include the first socket connector, the second socket connector and the two circuit boards. When the first connecting module is mated with the second connecting module, the junction ends of the two circuit boards are inserted into the first socket connector and the second socket connector, respectively, so that the junction ends of the two circuit boards are electrically connected to the first socket connector and the second socket connector, respectively. Accordingly, high-density signal contacts can be formed in the limited volume.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A high-density connecting device, comprising:

a first connecting module including a first casing assembly, a first circuit board, and a first socket connector, the first socket connector being disposed on one surface of the first circuit board and being electrically connected to the first circuit board, the first circuit board and the first socket connector being disposed in the first casing assembly, a first junction end being formed at one end of the first circuit board, a plurality of first contacts being disposed on at least one surface of the first junction end, the first socket connector being arranged in proximity to the first junction end on the one surface of the first circuit board; and a second connecting module including a second casing assembly, a second circuit board, and a second socket connector, the second socket connector being disposed on one surface of the second circuit board and being electrically connected to the second circuit board, the second circuit board and the second socket connector being disposed in the second casing assembly, a second junction end being formed at one end of the second circuit board, a plurality of second contacts being disposed on at least one surface of the second junction end, the second socket connector being arranged in proximity to the second junction end on the one surface of the second circuit board;

wherein, when the first connecting module is mated with the second connecting module, the first junction end of the first circuit board is inserted into the second socket connector, so that the first junction end of the first circuit board is electrically connected to the second socket connector, and the second junction end of the second circuit board is inserted into the first socket connector, so that the second junction end of the second circuit board is electrically connected to the first socket connector.

2. The high-density connecting device according to claim 1, wherein the plurality of first contacts are disposed on both surfaces of the first junction end, and the plurality of second contacts are disposed on both surfaces of the second junction end.

3. The high-density connecting device according to claim 1, wherein the first casing assembly includes a first casing and a first connector, the first connector is disposed at one end of the first casing, the first connector has a first body, a first space and a slot are formed in the first body, a partition plate is disposed between the first space and the slot, a first through hole and a second through hole are disposed on the first partition plate, the first circuit board and the first socket connector are disposed in the first space, the first junction end of the first circuit board passes through the first through hole and extends into the slot, and the first socket connector corresponds to the second through hole.

4. The high-density connecting device according to claim 3, wherein the second casing assembly includes a second casing and a second connector, the second connector is disposed at one end of the second casing, the second connector has a second body, a cylinder and a second space are formed in the second body, the cylinder corresponds to the slot, the cylinder is inserted into the slot when the first connecting module is mated with the second connecting module, the second space is arranged inside the cylinder, a second partition plate is disposed at one end of the cylinder, a third through hole and a fourth through hole are disposed on the second partition plate, the second circuit board and the second socket connector are disposed in the second space, the second junction end of the second circuit board passes through the third through hole and extends outside the cylinder, and the second socket connector corresponds to the fourth through hole.

5. The high-density connecting device according to claim 1, wherein at least one spring connector is disposed on the second circuit board or the first circuit board, the at least one spring connector includes an electrically insulating body and a plurality of spring terminals, the electrically insulating body has a plurality of wire slots arranged at intervals, the plurality of spring terminals are disposed on the electrically insulating body, the plurality of spring terminals each have a contact portion and a pin portion, the contact portion extends in a spiral pattern, a slit is formed in the contact portion, the pin portion is connected to the contact portion, the pin portion is electrically connected to the second circuit board or the first circuit board, the contact portions of the plurality of spring terminals extend into the plurality of wire slots, and the slits of the plurality of spring terminals are used for clamping wires.

6. A high-density connecting device, comprising a first connecting module including a first casing assembly and two first circuit boards, a first junction end being formed at one end of each of the two first circuit boards, a plurality of first contacts being disposed on at least one surface of the first junction end; and a second connecting module including a second casing assembly, a second circuit board, a first socket connector, and a second socket connector, the first socket connector being disposed on one surface of the second circuit board and being electrically connected to the second circuit board, the second socket connector being disposed on another surface of the second circuit board and being electrically connected to the second circuit board, the second circuit board, the first socket connector, and the second socket connector being disposed in the second casing assembly;

wherein, when the first connecting module is mated with the second connecting module, the first junction ends of the two first circuit boards are inserted into the first socket connector and the second socket connector, respectively, so that the first junction ends of the two first circuit boards are electrically connected to the first socket connector and the second socket connector, respectively.

7. The high-density connecting device according to claim 6, wherein the plurality of first contacts are disposed on both surfaces of the first junction end.

8. The high-density connecting device according to claim 6, wherein the first casing assembly includes a first casing and a first connector, the first connector is disposed at one end of the first casing, the first connector has a first body, a slot is formed in the first body, the two first circuit boards are disposed in the first body, and the first junction ends of the two circuit boards extend into the slot.

9. The high-density connecting device according to claim 8, wherein the second casing assembly includes a second casing and a second connector, the second connector is disposed at one end of the second casing, the second connector has a second body, a cylinder and a space are formed in the second body, the cylinder corresponds to the slot, the cylinder is inserted into the slot when the first connecting module is mated with the second connecting module, the space is arranged inside the cylinder, one end of the cylinder includes a partition plate, two through holes are disposed on the partition plate, the second circuit board, the first socket connector, and the second socket connector are disposed in the space, and the first socket connector and the second socket connector correspond to the two through holes, respectively.

10. The high-density connecting device according to claim 6, wherein at least one spring connector is disposed on the second circuit board or the first circuit board, the at least one spring connector includes an electrically insulating body and a plurality of spring terminals, the electrically insulating body has a plurality of wire slots arranged at intervals, the plurality of spring terminals are disposed on the electrically insulating body, the plurality of spring terminals each have a contact portion and a pin portion, the contact portion extends in a spiral pattern, a slit is formed in the contact portion, the pin portion is connected to the contact portion, the pin portion is electrically connected to the second circuit board or the first circuit board, the contact portions of the plurality of spring terminals extend into the plurality of wire slots, and the slits of the plurality of spring terminals are used for clamping wires.

* * * * *